US007427005B1

(12) United States Patent
Lohrman

(10) Patent No.: US 7,427,005 B1
(45) Date of Patent: Sep. 23, 2008

(54) DISPENSING CLOSURE, PACKAGE AND METHOD OF ASSEMBLY WITH FILM SEAL PIERCING

(75) Inventor: Richard D. Lohrman, Sylvania, OH (US)

(73) Assignee: Owens-Illinois Closure Inc., Perrysburg, OH (US)

( * ) Notice: Subject to any disclaimer, the term of this patent is extended or adjusted under 35 U.S.C. 154(b) by 899 days.

(21) Appl. No.: 10/307,148

(22) Filed: Nov. 27, 2002

(51) Int. Cl.
*B67D 5/00* (2006.01)
*B65D 47/01* (2006.01)
*B65D 47/00* (2006.01)

(52) U.S. Cl. ..... 222/541.2; 222/83; 222/546

(58) Field of Classification Search ..... 222/83, 222/546, 541.2, 542.5, 541.6, 258, 541.5, 222/321.1, 321.7, 340, 556; 215/250, 252, 215/235; 220/258
See application file for complete search history.

(56) References Cited

U.S. PATENT DOCUMENTS

| | | | | |
|---|---|---|---|---|
| 3,074,592 | A | 1/1963 | Stocking | |
| 3,172,478 | A | 3/1965 | Giclas | |
| 3,339,812 | A | 9/1967 | Meissner | |
| 3,406,872 | A | 10/1968 | Fiquet | |
| 3,940,003 | A | 2/1976 | Larson | |
| 4,722,449 | A * | 2/1988 | Dubach | 215/235 |
| 4,770,305 | A | 9/1988 | Su | |
| 4,795,043 | A | 1/1989 | Odet | |
| 4,867,326 | A | 9/1989 | O'Meara | |
| 4,884,703 | A | 12/1989 | O'Meara | |
| 4,898,293 | A | 2/1990 | Morel | |
| 4,907,722 | A | 3/1990 | Ueda | |
| 5,020,690 | A | 6/1991 | Kishikawa | |
| 5,141,133 | A | 8/1992 | Ninomiya | |
| 5,147,070 | A | 9/1992 | Iwamoto | |
| 5,228,592 | A | 7/1993 | Pellerano | |
| 5,255,812 | A | 10/1993 | Hsu | |
| 5,273,171 | A | 12/1993 | Steele-Rowland | |
| 5,292,025 | A | 3/1994 | Dubreul | |
| 5,419,459 | A | 5/1995 | O'Meara | |
| 5,477,972 | A | 12/1995 | Lester | |
| 5,482,176 | A | 1/1996 | Maietta | |
| 5,590,798 | A | 1/1997 | O'Connell | |
| 5,758,788 | A | 6/1998 | Lifshey | |

(Continued)

FOREIGN PATENT DOCUMENTS

| | | |
|---|---|---|
| DE | 616408 | 7/1935 |

(Continued)

*Primary Examiner*—Kevin Shaver
*Assistant Examiner*—Melvin A. Cartagena
(74) *Attorney, Agent, or Firm*—Reising, Ethington, Barnes, Kisselle, P.C.

(57) ABSTRACT

A closure for dispensing product from a container having a film seal across the mouth of the container finish includes a base having a deck that is adapted to overlie the film seal on the container finish and a dispensing opening in the deck. A lid is secured by a hinge to an edge of the base for overlying the deck. A spud is aligned with the dispensing opening and secured to the cover by one or more frangible elements. The spud is adapted, after rupture of the frangible elements, to move into the dispensing opening in the deck either directly or through an intervening spout, to pierce the film seal, and thereafter to function as a plug seal when the lid is closed.

35 Claims, 4 Drawing Sheets

U.S. PATENT DOCUMENTS

| | | | | |
|---|---|---|---|---|
| 5,806,699 | A | 9/1998 | Ekkert | |
| 5,848,690 | A | 12/1998 | Granger | |
| 5,869,328 | A | 2/1999 | Antoci | |
| 5,947,318 | A | 9/1999 | Palm | |
| 5,960,992 | A | 10/1999 | Bernstein | |
| 5,992,668 | A | 11/1999 | Elliott | |
| 6,003,728 | A | 12/1999 | Elliott | |
| 6,041,477 | A | 3/2000 | Rentsch | |
| 6,045,004 | A | 4/2000 | Elliott | |
| 6,056,142 | A | 5/2000 | Elliott | |
| 6,116,445 | A | 9/2000 | Ikemori | |
| 6,161,728 | A | 12/2000 | Dark | |
| 6,193,108 | B1 * | 2/2001 | Lepsius et al. | 222/83 |
| 6,206,222 | B1 | 3/2001 | Cudzik | |

FOREIGN PATENT DOCUMENTS

| | | |
|---|---|---|
| FR | 1117703 | 5/1956 |
| FR | 1479110 | 4/1967 |

* cited by examiner

100

DISPENSING CLOSURE, PACKAGE AND METHOD OF ASSEMBLY WITH FILM SEAL PIERCING

The present invention relates to packages for dispensing fluid products such as body lotions and food condiments (e.g., ketchup and mustard). The invention relates more particularly to dispensing closures for such packages, and to methods of manufacture, in which the closure includes facility for piercing a film seal disposed across the mouth of the package container.

BACKGROUND AND SUMMARY OF THE INVENTION

Dispensing packages of the subject character include a container having a flexible resilient body and a dispensing closure secured to the finish of the container for dispensing fluid product through a dispensing opening when the container body is squeezed. A film liner or seal is typically welded or otherwise secured across the mouth of the container, between the closure and the container finish, to maintain freshness of the product within the container between filling and first use, to prevent dispensing during shipment and handling, and to indicate possible tampering when broken. The closure typically must be removed from the container in order to remove or pierce the film seal and enable dispensing of product from the container, after which the closure must be resecured to the container. A general object of the present invention is to provide a closure having facility for piercing the liner, and thereby enabling the dispensing of product from the package, without having to remove the closure from the container. Another and related object of the invention is to provide a dispensing package embodying such a closure, and a method of making such a closure.

A closure for dispensing product from a container having a film seal across the mouth of the container finish, in accordance with one aspect of the present invention, includes a base having a deck that is adapted to overlie the film seal on the container finish and a dispensing opening in the deck. A lid is secured to the deck by a hinge for overlying the deck in a closed position of the lid. A spud is aligned with the dispensing opening and secured by frangible means to the lid. The spud is adapted, after rupture of the frangible means, to move into the dispensing opening in the deck either directly or through an intervening spout, pierce the film seal to enable dispensing of product when the lid is opened, and thereafter function as a plug seal when the lid is closed.

A closure and container package in accordance with another aspect of the present invention includes a container having a mouth surrounded by a finish, and a film seal secured to the finish overlying and closing the mouth. A closure includes a base having a deck with a dispensing opening and a skirt secured to the container finish such that the deck overlies the film seal. A lid is secured to the base by a hinge. A spud is secured by frangible means to the lid and is aligned with the dispensing opening in the deck of the base. The spud is adapted, upon fracture of the frangible means, to move into the dispensing opening in the deck either directly or through an intervening spout, pierce the film seal, and thereafter function as a plug seal when the lid is closed.

A method of making a dispensing closure in accordance with yet another aspect of the present invention includes integrally molding a base having a deck with a dispensing opening, a lid having an opening, and a hinge pivotally securing the lid to the base. A spud element is frangibly secured to the lid within the lid opening. This frangible securement may be accomplished by molding the spud integrally with the lid, or more preferably by molding a separate spud that is subsequently secured within the lid opening.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
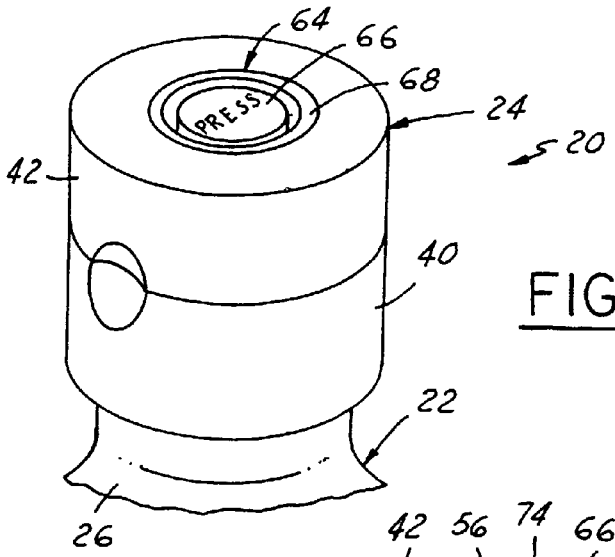
FIG. 1 is a fragmentary perspective view of a closure and container package in accordance with one exemplary presently preferred embodiment of the invention.

FIGS. 1-4 illustrate a dispensing package 20 that includes a container 22 and a dispensing closure 24 assembled to the container. Container 22 includes a body 26 of flexible resilient construction such as molded plastic. A cylindrical finish 28 extends from container body 26 for securement of closure 24. A film liner or seal 30 extends across the mouth 32 of container finish 28 and is welded or otherwise secured to the container mouth to seal the contents of the container. Film seal 30 may comprise, for example, a underlayer 34 (FIG. 2) of plastic and an overlayer 36 of electrically conductive metal foil. Following filling of the container and securement of closure 24, film seal 30 may be welded to the end of container finish 28 by conventional induction welding techniques. Film seal 30 may include additional support layers of cellulose or other suitable materials. Film seal 30 must, of course, be removed or punctured to enable dispensing of product from the package.

Dispensing closure 24 includes a base 40 and a cover or lid 42 integrally molded with base 40 and pivotally coupled thereto by an integral hinge 44. Hinge 44 preferably comprises a pair of laterally spaced hinge elements of the type disclosed in U.S. Pat. No. 6,041,477. Hinge 44 alternatively may comprise a single-element hinge, or a suitable multiple-element hinge such as of the type illustrated in U.S. Pat. Nos.

4,638,916 and 5,489,035 for example. The specific structure of hinge 44 is not directly germane to the present invention.

Figure 2:
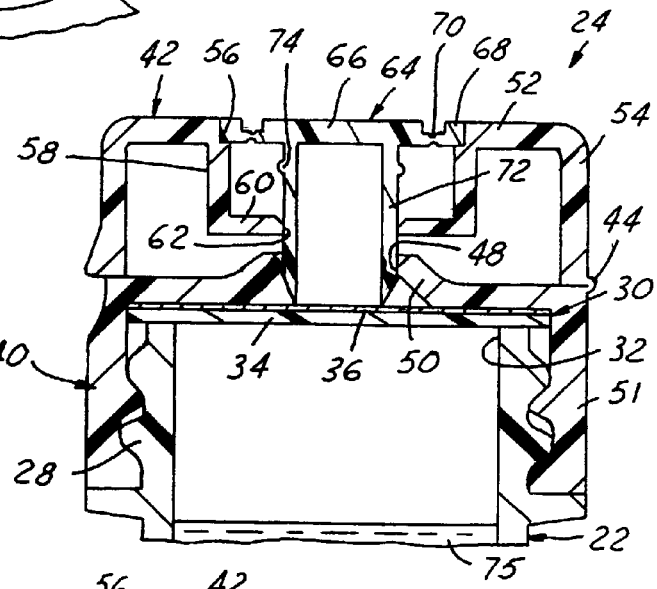
FIG. 2 is a fragmentary sectional view that bisects the closure and container package illustrated in FIG. 1.
Figure 3:
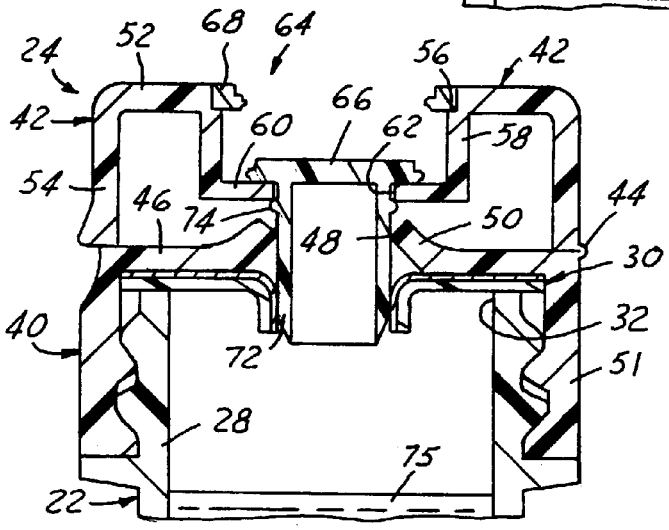
FIG. 3 is a fragmentary sectional view that is similar to that of FIG. 2 but illustrates the package ready to dispense product with the film seal ruptured.
Figure 4:
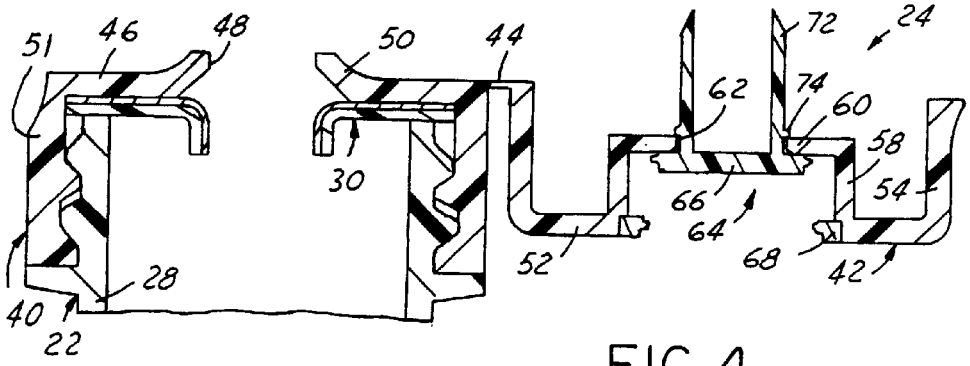
FIG. 4 is a fragmentary sectional view of the package illustrated in FIG. 3 but with the lid of the closure in an open position to dispense product.

Closure base 40 includes a deck 46 having a dispensing opening 48, the upper edge of which preferably is raised from the surface of deck 46 such as by a conical wall 50 in the embodiment of FIGS. 2-4. Deck 46 may be flat (as shown) or domed. A peripheral skirt 51 depends from deck 46 and has one or more internal threads or beads engaged with corresponding external threads or beads on container finish 28 for securing closure base 40 to container finish 28. Lid or cover 42 includes a wall 52, which preferably is flat and parallel to deck 46 in the closed position of lid 42 (FIGS. 2 and 3). Lid 42 also has a peripheral skirt 54 for abutting engagement with an upper surface of base 40 and coupling to hinge 44. (Directional words such as "upper" and "lower" are employed by way of description and not limitation with respect to the upright orientation of the packages and the closed positions of the lids illustrated in the drawings. Directional words such as "radial" and "axial" are employed by way of description and not limitation with respect to the central axis of the container finish or the skirt of the closure base as appropriate.) Wall 52 of lid 42 is spaced from deck 46 in the closed position of lid 42 (FIGS. 2-3), and has an opening that preferably is surrounded in this embodiment by an axially facing recessed ledge 56. An internal well on lid 42 includes an annular wall 58 that extends downwardly from wall 52 surrounding the wall opening, and a base wall 60 that is parallel to deck 46 in the closed position of the lid. Base wall 60 has a base wall opening 62 that is aligned with dispensing opening 48 in the closed position of the lid.

A spud 64 is secured to cover wall 52. Spud 64 in the embodiment of FIGS. 1-4 includes a spud element 66 that is connected to a peripheral ring 68 by frangible means 70, such as a frangible web or a circumferential array of frangible bridges. Spud ring 68 is seated on shoulder 56 of lid wall 52 and is secured to the lid by suitable means such as press-fit or adhesion. The upper surfaces of spud element 66 and spud ring 68 preferably are flush with the upper surface of lid wall 58, as best seen in FIGS. 1 and 2. Spud element 66 has an annular collar or sleeve 72 that extends through base wall opening 62 in this embodiment and into dispensing opening 48 of base 40 in the closed position of the lid. The lower end of spud element 64 is adjacent to the upper surface of film seal 30 as initially assembled, as best seen in FIG. 2. A circumferentially continuous or segmented bead 74 extends around the outer surface of spud collar 72 at a position spaced from the head of the spud element for engagement with base wall 60, as will be described.

Film seal 30 preferably is provided in a subassembly within closure base 40, either by the closure manufacturer or by a packager. After container 22 has been filled with product 75 (FIG. 2), closure 24 is secured over the container finish and film seal 30 is welded to the open end of the container finish. Film seal 30 alternatively, but less preferably, may be welded or otherwise secured to container finish 28 prior to assembly of closure 24 to the finish. Closure base 40 and container finish 28 preferably include teeth or other suitable means (not shown) to prevent removal of closure 24 from the container finish. When it is desired to dispense product from the package for the first time, spud element 64 is pressed downwardly, in the orientation of FIGS. 1-3, to rupture frangible bridges or web 70 and push spud collar 72 through openings 62, 48. The lower end of collar 72 pierces film seal 30, as illustrated in FIG. 3, preferably being sharpened to facilitate this piercing operation. In the fully lowered or recessed position of spud element 66 with respect to lid 42, as shown in FIG. 3, bead 74 on spud collar 72 is received by snap fit under base wall 60 surrounding opening 62. The upper inside edge of opening 62 is angled to receive bead 74, while the lower inside edge of opening 62 is sharp to resist removal of bead 74 and spud element 66. Spud element 66 is thus firmly secured to base wall 60, with base wall 60 being captured by snap fit between bead 74 and the head of the spud element. Lid 42 may then be pivoted about hinge 44 from the closed position illustrated in FIGS. 1-3 to the open position illustrated in FIG. 4, at which point dispensing opening 48 is open and product may be dispensed from the container. After dispensing product from the container, lid 24 may be pivoted from the position of FIG. 4 back to the position of FIG. 3, at which collar 72 of spud element 66 functions as a plug seal within dispensing opening 48 of base 40. Indicia such as "PRESS" may be provided on or adjacent to the upper surface of spud element 66, as illustrated in FIG. 1, to advise the user how to manipulate the spud element to pierce film seal 30 and prepare the package for dispensing product.

Figure 5:
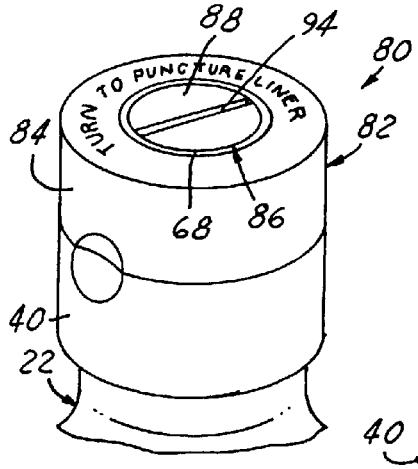
FIG. 5 is a fragmentary perspective view which is similar to that of FIG. 1 but illustrates a second exemplary embodiment of the invention.
Figure 6:
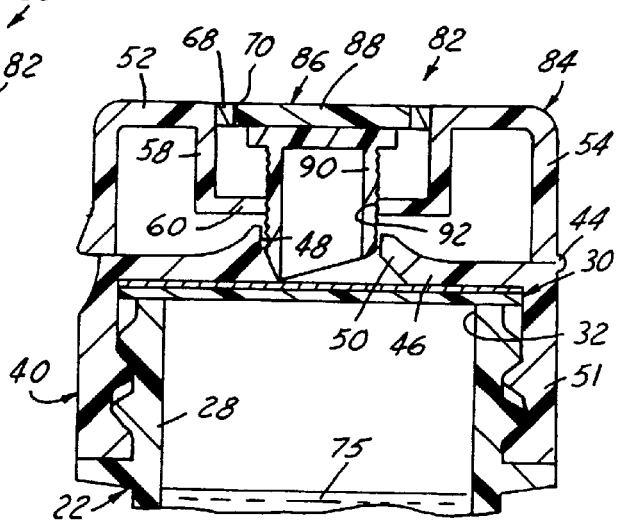
FIGS. 6 and 7 are fragmentary sectional views that are similar to those of FIGS. 2 and 3 but illustrate the embodiment of the invention in FIG. 5.
Figure 7:
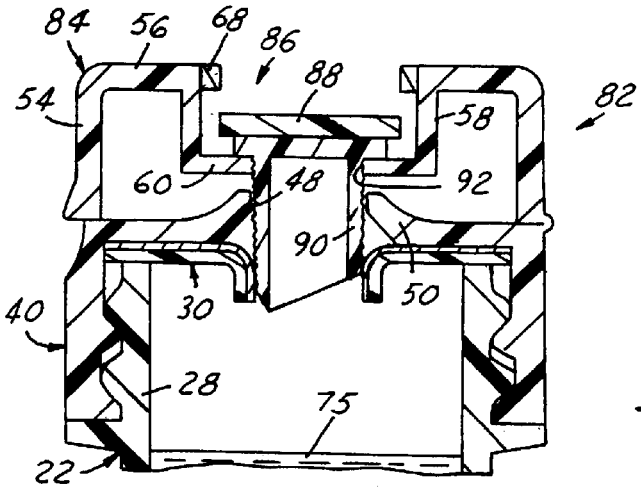

FIGS. 5-7 illustrate a package 80 that includes a dispensing closure 82 in accordance with a modified embodiment of the invention. Reference numerals in FIGS. 5-7 (and FIGS. 8-10) that are identical to reference numerals employed in FIGS. 1-4 indicate identical components. Closure 82 in FIGS. 5-7 includes a lid 84 integrally connected to base 40 by hinge 44. A spud 86 includes a ring 68 secured to wall 52 of lid 84, and a spud element 88 mounted within ring 68 by a frangible web or frangible bridges as in the embodiment of FIGS. 1-4. Spud element 88 includes an internal collar 90 having external threads engaged with corresponding internal threads around opening 92 in base wall 60. In this embodiment, a slot 94 (FIG. 5) is provided on the upper surface of spud element 88, and indicia such as "TURN TO PUNCTURE LINER" are provided on the upper surface of spud element 88, spud ring 68 or lid wall 52 to advise a user to turn the spud element employing a coin or the like in slot 94. Such turning of spud element 88 advances the spud element through opening 92 by means of the engaged threads to pierce film seal 30 (FIG. 6 to FIG. 7) and permit dispensing of product. The embodiment of FIGS. 5-7 also illustrates a modification to spud element 88 whereby the sharpened lower end of spud collar 90 is angled to facilitate piercing of film seal 30. This modification can also be implemented in the embodiment of FIGS. 1-4 (and the embodiment of FIGS. 8-10).

Figure 8:
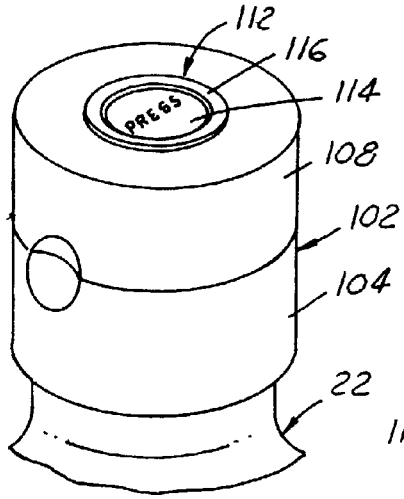
FIG. 8 is a fragmentary perspective view of a closure and container package in accordance with a third exemplary embodiment of the invention.
Figure 9:
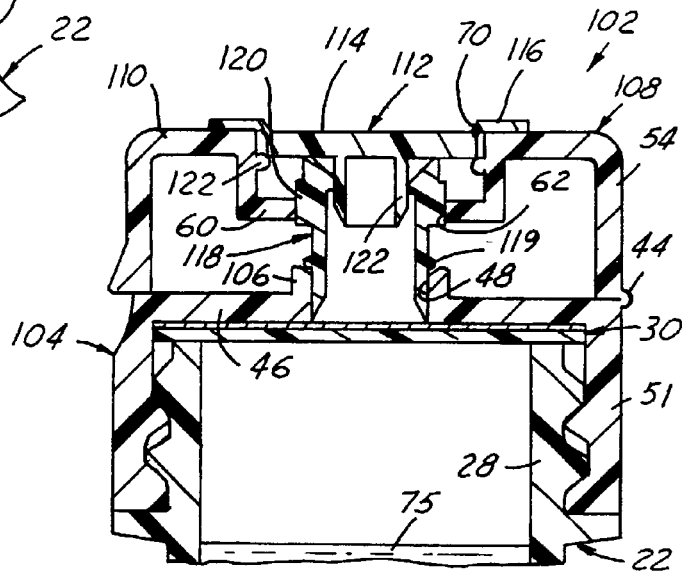
FIGS. 9 and 10 are fragmentary sectional views that are similar to those of FIGS. 2 and 3 but illustrate the embodiment of the invention in FIG. 8.
Figure 10:
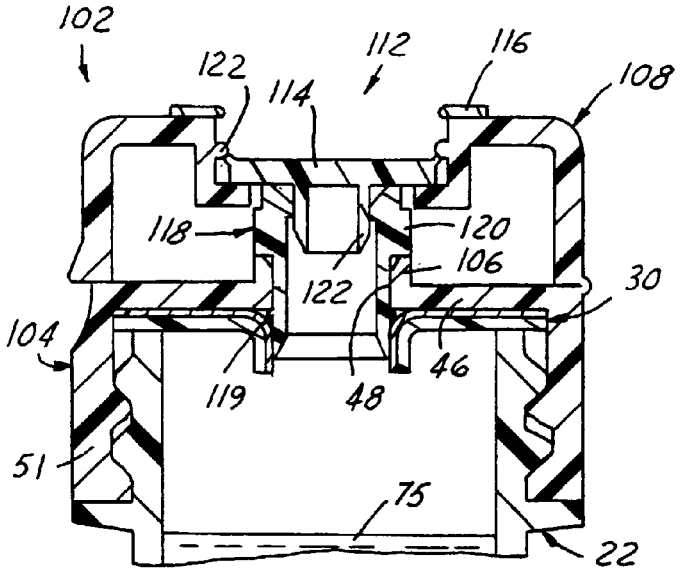

FIGS. 8-10 illustrate a package 100 that includes a dispensing closure 102 secured to the finish of container 22. Closure 102 includes a base 104 that is similar to base 40 in FIGS. 1-7 except that dispensing opening 48 is surrounded and defined by a cylindrical wall 106 rather than conical wall 50 in FIGS. 1-7. A lid 108 is connected to base 104 by hinge 44. Lid 108 includes an upper wall 110 to which a spud 112 is secured. Spud 112 includes a spud element 114 connected by frangible web or bridges 70 to a ring 116, which is disposed in this embodiment on the upper surface of lid wall 110 rather than flush with the upper surface of the lid wall as in the prior embodiments. A cylindrical spout 118 is frictionally slidably carried within opening 62 in lid base wall 60. Spout 118 includes a cylindrical body having an external bead 119, which can be circumferentially continuous or discontinuous. In the initial position of spout 118 illustrated in FIG. 9, the sharpened lower end of the spout is disposed adjacent to film seal 30, and the upper end of spout 118 underlies the top wall or head of spud element 114. When spud element 114 is pressed downwardly (see the "PRESS" indicia in FIG. 8), spud element 114 pushes spout 118 downwardly to pierce film seal 30 and enable dispensing of product. This downward motion of spout 118 clears opening 62 in base wall 60 so that the spout is no longer frictionally coupled to the lid. Spout 118 remains in the lowered position piercing film seal 30 (FIG. 10), with an external shoulder 120 on spout 118 in abutting engagement with the upper end of wall 106 that surrounds dispensing opening 48, and with bead 119 on spout 118 snapped beneath wall 46. A bead 122 on lid 112 holds spud element 114 in position. Spud element 114 remains with lid 108 as lid 108 is opened and closed, with collar 122 of spud element 114 forming a plug seal within spout 118 in the closed position of the lid (FIG. 10). Bead 119 and shoulder 120 cooperate with wall 106 to retain the spout in the lowered position. It will be noted in FIG. 10 that the sharpened lower end of spout 118, which remains in the lowered position after piercing the liner, cooperates with the surrounding inside surface of container finish 28 to form a trap for any liquid that forms or condenses on the surface of the product within the container so that this liquid is not dispensed with the product.

Figure 11:
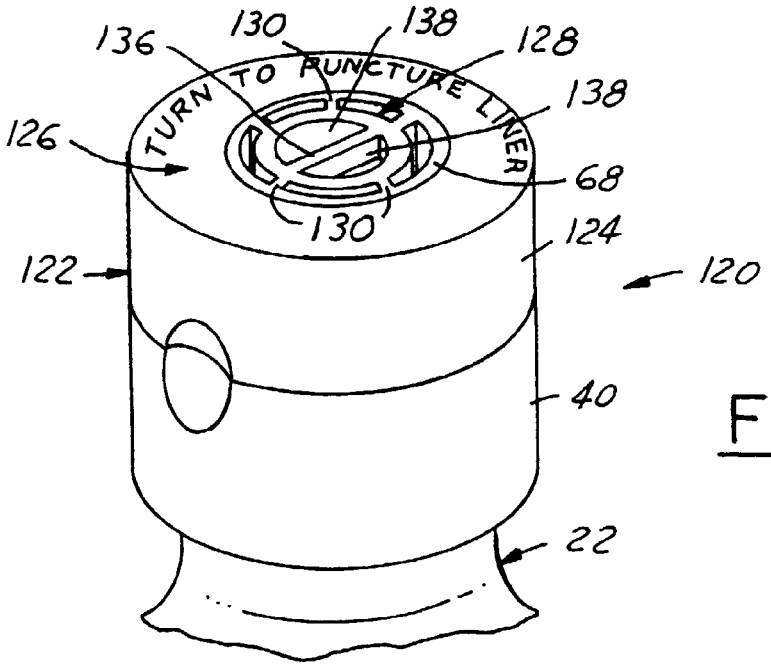
FIG. 11 is a fragmentary perspective view of a closure and container package in accordance with a fourth exemplary embodiment of the invention.
Figure 12:
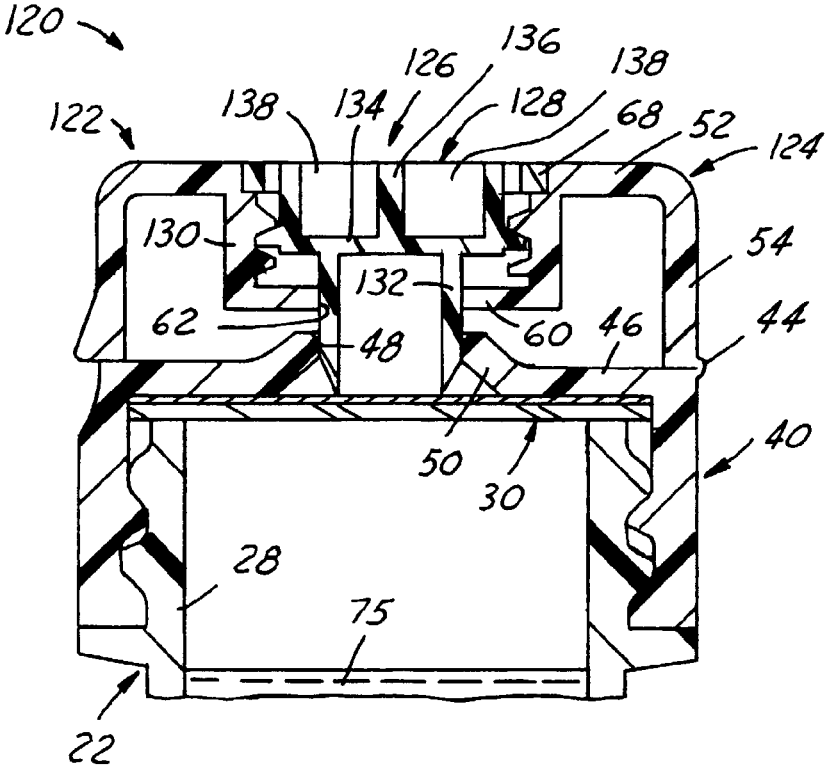
FIG. 12 is a fragmentary sectional view that bisects the closure and container package of FIG. 11.

FIGS. 11 and 12 illustrate a package 120 that is a modification to the package 80 in FIGS. 5-7. A closure 122 includes a base 40 and a lid 124. A spud 126 is secured to lid wall 52, and includes a spud element 128 secured by frangible bridges 130 (FIG. 11) to a ring 68 mounted on lid wall 52. Lid 124 includes a well having a cylindrical sidewall 130 with one or more internal threads that engage corresponding external threads on the outer periphery of spud element 128. Spud element collar 132 is freely slidable in dispensing opening 48 on base deck 46 in this embodiment. The upper end or head 134 of spud element 128 in this embodiment includes a cross rib 136 having spaces 138 on either side of the rib. Spaces 138 are sized to permit insertion of the ends of a user's thumb and forefinger to grasp cross rib 136 and turn the spud element into the closure lid well. Advancement of the spud element into the well, by means of engaged threads on the spud element and the well sidewall, advances collar 132 to pierce film seal 30 and thereafter function as a plug seal within dispensing opening 48 in the closed position of the lid. The remaining elements in package 120 of FIGS. 11 and 12 are similar to the correspondingly numbered elements in package 80 of FIGS. 5-7.

There have thus been disclosed a closure, a package and a method of manufacture that fully satisfy all of the objects and aims previously set forth. The invention has been disclosed in connection with three presently preferred embodiments thereof, and a number of modifications and variations have been discussed. In addition to piercing the film seal or liner without requiring removal of the closure from the container finish, the various embodiments of the invention additionally provide a tamper-indicating function in that fracture of the frangible means that secure the spud element in the initial position indicate that the film seal may have been pierced. Other modifications and variations will readily suggest themselves to persons of ordinary skill in the art. For example, the illustrated embodiments of the invention embody a spud 64, 86, 112 or 126 that is separate from the associated lid 42, 84, 108 or 124. These spuds may be fabricated as separate elements that are subsequently secured to the closure lid, or may be fabricated with the closure lid in an insert molding, a bi-injection molding or a two-stage molding operation. It is also contemplated that spud 64, 86, 112 or 126 may be molded integrally with the lid, in which event the spud ring 56, 68 or 116 simply becomes part of the lid wall 52 or 110 to which the spud element 66, 88, 114 or 128 is frangibly connected. In the embodiment of FIGS. 8-10, spout 120 may be fabricated with closure lid 108 in an insert molding, a bi-injection molding or a two-stage molding operation as long as the spout element is of a material that does not bond to the material of the lid and can be readily separated from the lid to puncture the film seal (FIG. 9 to FIG. 10). Skirt 51 of closure base 40 or 104 preferably is cylindrical. However, where snap beads are employed for securing the closure, the closure skirt and the container finish may be non-cylindrical to maintain a desired angular orientation between the closure and the container. As another alternative, base 40 or 104 may be a dual-wall base, having an inner cylindrical skirt for securement to the container finish and an outer skirt of a contour, such as oval or polygonal, to match the contour of the container sidewall. Tamper-indicating means may be provided between the closure base and lid. The invention is intended to embrace all such modifications and variations as fall within the spirit and broad scope of the appended claims.

The invention claimed is:

1. A closure for dispensing product from a container having a finish and a film seal extending across a mouth of the finish, said closure including:

a base having a deck that is adapted to overlie the film seal on the container finish and a dispensing opening in said deck, a lid secured by a hinge to said base for overlying said deck in a closed position of said lid, and means frangibly secured to said lid and aligned with said dispensing opening in said closed position of said lid, said means being adapted upon rupture of frangible securement to said lid to move into said dispensing opening in said deck, pierce the film seal to enable dispensing of product in an open position of said lid, and thereafter function as a plug seal in said closed position of said lid.

2. The closure set forth in claim 1 wherein said means includes a ring secured to said lid and a spud element frangibly secured within said ring, said spud element being movable with respect to said ring upon rupture of frangible securement to said ring.

3. The closure set forth in claim 2 wherein said spud element has an upper end frangibly secured to said ring and a lower end for entering said dispensing opening and piercing the film seal.

4. The closure set forth in claim 2 wherein said means further includes a spout movably disposed on said base, movement of said spud element upon rupture of frangible securement to said ring pushing said spout through said dispensing opening to pierce the film seal, said spout thereafter forming an extension of said dispensing opening and said spud element forming a plug seal within said spout in said closed position of said lid.

5. The closure set forth in claim 4 wherein said spout has an end remote from said spud element that is adapted to extend through said dispensing opening in said deck and form an annular space between a radially outer surface of said spout and a radially inner surface of said skirt.

6. The closure set forth in claim 2 wherein said lid has a well and said spud element is secured to said lid such that said spud element extends through said well and is movable into said well upon rupture of the frangible securement to said ring.

7. A closure for dispensing product from a container having a finish and a film seal extending across a mouth of the finish, said closure including:

a base having a deck that is adapted to overlie the film seal on the container finish and a dispensing opening in said deck, a lid secured by a hinge to said base for movement between a closed position overlying said deck and an open position spaced from said deck, and piercing means including a spud element secured by frangible means to said lid at a position to extend into said dispensing opening in said closed position of said lid, said seal piercing means having an end that is adapted to move in said closed position of said lid from a first position in which said spud element is connected to said lid by said frangible means to a second position upon fracture of said frangible means in which said seal piercing means are adapted to pierce the film seal on the container finish.

8. The closure set forth in claim 7 further including supplemental means for securing said spud element to said lid in said second position of said seal piercing means such that said spud element is adapted to function as a plug seal in said closed position of said lid.

9. The closure set forth in claim 8 wherein said supplemental means comprises a snap bead on said spud element engaged with said lid in said second position of said seal piercing means.

10. The closure set forth in claim 8 wherein said supplemental means comprises engaged threads on said lid and said spud element.

11. The closure set forth in claim 7 wherein said seal piercing means include a spout movably disposed within said dispensing opening, said spud element being adapted to move said spout, in said closed position of said lid and upon fracture of said frangible means, through said dispensing opening to pierce the foil liner, said spout thereafter forming an extension of said dispensing opening and said spud element forming a plug seal within said spout in said closed position of said lid.

12. The closure set forth in claim 11 wherein said spout includes a snap bead for engaging said deck to hold said spout in position piercing said liner.

13. A closure for dispensing product from a container having a finish and a film seal extending across a mouth of the finish, said closure including:

a base having a deck that is adapted to overlie the film seal on a container finish, a skirt for securing the base to a container finish, and a dispensing opening in said deck, a lid secured by a hinge to said base for movement between a closed position overlying said deck and an open position spaced from said deck, said lid having a lid wall that is spaced from said deck and a well extending from said lid wall, said well having a base wall with a wall opening aligned with said dispensing opening in said closed position of said lid, and a spud element secured by frangible means to said lid and extending into said well, said spud element having a first end coupled by said frangible means to said lid adjacent to said lid wall and a second end adjacent to said base wall opening in a first position of said spud element in said closed position of said lid, said spud element being adapted to be moved in said closed position of said lid to a second position, upon fracture of said frangible means, into said well and into abutment with said base wall, and in which said spud element is adapted to cause piercing of the film seal on the container finish.

14. The closure set forth in claim 13 wherein said spud element is secured by said frangible means to a spud ring that is secured to said lid such that said ring and said first end of said spud element are flush with an outer surface of said lid in said first position of said spud element.

15. The closure set forth in claim 13 further including indicia on said first end of said spud element or on said lid wall adjacent to said spud element for instructing a user how to move said spud element from said first position to said second position.

16. The closure set forth in claim 13 further including supplemental means on said spud element and said base wall for securing said spud element to said base wall within said well.

17. The closure set forth in claim 16 wherein said supplemental means include a bead on said spud element in engagement with said base wall opening.

18. The closure set forth in claim 16 wherein said supplemental means include engaged threads on said spud element and around said base wall opening.

19. A closure for dispensing product from a container having a finish and a film seal extending across a mouth of the finish, said closure including:

a base having a deck that is adapted to overlie the film seal on a container finish, a skirt for securing the base to a container finish, a dispensing opening in said deck, and a spout movably disposed in said dispensing opening, a lid secured by a hinge to said base for movement between a closed position overlying said deck and an open position spaced from said deck, said lid having a lid wall that is spaced from said deck and a well extending from said lid wall, said well having a base wall with a wall opening aligned with said dispensing opening in said closed position of said lid, and a spud element secured by frangible means to said lid and extending into said well, said spud element having a first end coupled by said frangible means to said lid adjacent to said lid wall and a second end adjacent to said base wall opening in a first position of said spud element in said closed position of said lid, said spud element being adapted to move with respect to said lid, in said closed position of said lid and upon fracture of said frangible means, to move said spout through said dispensing opening to pierce the foil liner, said spout thereafter forming an extension of said dispensing opening and said spud element forming a plug seal within said spout in said closed position of said lid.

20. The closure set forth in claim 19 wherein said spout includes a snap bead for engaging said deck to hold said spout in said position piercing said liner.

21. The closure set forth in claim 19 wherein said spud element is secured by said frangible means to a spud ring that is secured to said lid such that said ring and said first end of said spud element are flush with an outer surface of said lid in said first position of said spud element.

22. The closure set forth in claim 19 further including indicia on said first end of said spud element or on said lid wall adjacent to said spud element for instructing a user how to move said spud element from said first position to said second position.

23. A closure for dispensing product from a container having a finish and a film seal extending across a mouth of the finish, said closure including:

a base having a deck that is adapted to overlie the film seal on the container finish, a skirt for securement to the container finish, and a dispensing opening in said deck, a lid secured by a hinge to an edge of said base for overlying said deck, and seal piercing means separate from said lid and movably mounted on said lid in alignment with said dispensing opening, said seal piercing means being adapted to move with respect to said lid toward said dispensing opening in said deck, to pierce the film seal, and thereafter to function as a plug seal when said lid is closed.

24. A closure and container package that includes:

a container having a finish and mouth surrounded by said finish, a film seal secured to said finish overlying and closing said mouth, and a closure secured to said finish, said closure including:

a base having a deck with a dispensing opening and a skirt secured to said finish such that said deck overlies said film seal, a lid secured to said base by a hinge, and seal piercing means aligned with said dispensing opening and secured by frangible means to said lid, said seal piercing means being adapted upon fracture of said frangible means to move through said dispensing opening in said deck to pierce said film seal, and thereafter to function as a plug seal within said dispensing opening when the lid is closed.

25. The package set forth in claim 24 wherein said seal piercing means include a ring secured to said lid and a spud element secured by said frangible means within said ring, said spud element being movable with respect to said ring upon rupture of said frangible means.

26. The package set forth in claim 25 wherein seal piercing means including said spud element have an upper end secured to said ring by said frangible means and a lower end for entering said dispensing opening and piercing said film seal.

27. The package set forth in claim 24 wherein said seal piercing means include a spout movably disposed on said deck, movement of said spud element upon rupture of said frangible means pushing said spout through said dispensing opening to pierce the foil liner, said spout thereafter forming an extension of said dispensing opening and said spud element forming a plug seal within said spout.

28. The package set forth in claim 27 wherein said spout has an end remote from said spud element that is adapted to extend through said dispensing opening in said deck and form an annular space between a radially outer surface of said spout and a radially inner surface of said skirt.

29. The package set forth in claim 24 wherein said lid has a well and said spud element is secured to said lid such that said spud element extends through said well and is movable into said well upon rupture of said frangible means.

30. A method of making a dispensing closure that comprises the steps of:

(a) integrally molding a base having a deck with a dispensing opening, a lid having a lid opening, and a hinge pivotally securing the lid to the base, and (b) frangibly securing a spud element to said lid within said lid opening.

31. The method set forth in claim 30 wherein said step (b) is carried out by providing said spud element frangibly secured to a spud ring, and securing said spud ring to said lid within said opening.

32. The method set forth in claim 31 wherein said spud ring is molded into said lid during said step (a).

33. The method set forth in claim 30 wherein said step (a) and (b) are carried out in a single molding step.

34. A method of making a dispensing closure that comprises the steps of:

(a) integrally molding a base having a deck with a dispensing opening, a lid having an opening, and a hinge pivotally securing said lid to said base for movement between a closed position in which said lid overlies said deck and said opening in said lid aligns with said dispensing opening, and an open position in which said lid is spaced from said deck, and (b) frangibly securing a spud element to said lid within said opening in said lid.

35. The method set forth in claim 34 wherein said step (a) includes molding a well in said lid around said opening in said lid such that said well has a base wall with an opening, and said step (b) includes securing said spud element to said lid such that said spud element extends through said base wall opening.

* * * * *